United States Patent [19]

Lagodmos

[11] 4,231,418

[45] Nov. 4, 1980

[54] CRYOGENIC REGENERATOR

[75] Inventor: George P. Lagodmos, Los Angeles, Calif.

[73] Assignee: Hughes Aircraft Company, Culver City, Calif.

[21] Appl. No.: 36,894

[22] Filed: May 7, 1979

[51] Int. Cl.[3] ..... F23L 15/02; F28D 17/00; F25B 9/00

[52] U.S. Cl. ..... 165/4; 62/6

[58] Field of Search ..... 62/6; 165/4, 10

[56] References Cited

U.S. PATENT DOCUMENTS

| | | | |
|---|---|---|---|
| Re. 27,338 | 4/1972 | Cowans | 62/6 |
| 1,275,507 | 8/1918 | Vuilleumier | 62/6 |
| 3,148,512 | 9/1964 | Hoffman et al. | 62/6 |
| 3,218,815 | 11/1965 | Chellis et al. | 62/6 |
| 3,379,026 | 4/1968 | Cowans | 62/6 |
| 3,678,992 | 7/1972 | Daniels | 62/6 |
| 3,742,719 | 7/1973 | Lagodmos | 62/6 |
| 3,969,907 | 7/1976 | Doody | 62/6 |

*Primary Examiner*—Lloyd L. King

*Attorney, Agent, or Firm*—Allen A. Dicke, Jr.; W. H. MacAllister

[57] ABSTRACT

Regenerator for a cryogenic system has lead sphere 58 packing and has grooves 54 and 56 in the regenerator walls to prevent gas bypass. Felt packing 66 between screens 64 and 68 causes continued compression of the regenerator packing as it changes size due to temperature changes. Gas spaces between the regenerator spheres is maintained low and regenerator sphere damage due to high intersphere loading is minimized.

15 Claims, 3 Drawing Figures

Fig. 1.
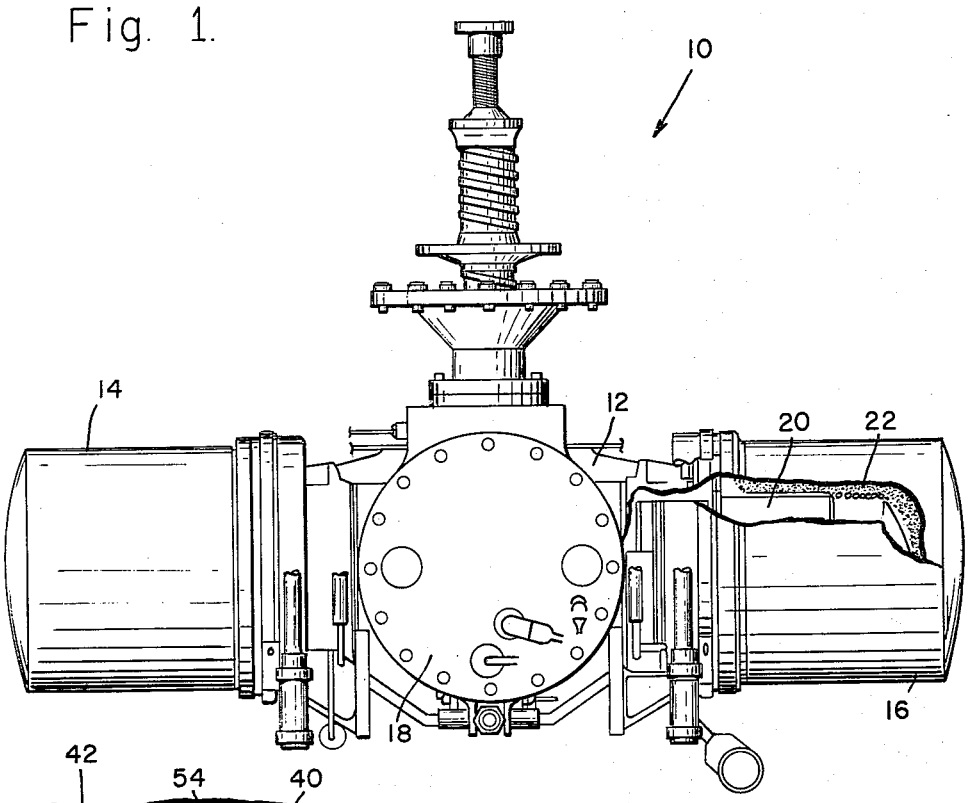
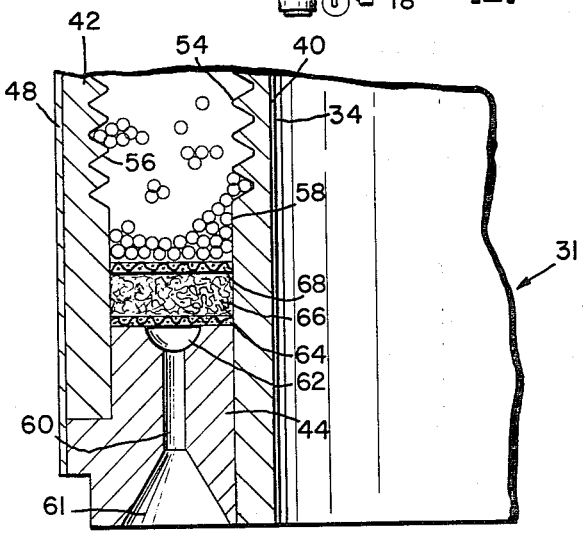
Fig. 3.

CRYOGENIC REGENERATOR

This invention was made in the performance of U.S. Government, Department of Defense contract F33615-71-C-1029. The United States Government has right to this invention.

BACKGROUND OF THE INVENTION

This invention is directed to a cryogenic regenerator, and particularly a regenerator having structural features for improved gas flow distribution, reduction in regenerator packing compression, and regenerator packing blowby.

Regenerators are widely employed in the cryogenic arts. With cyclic reversal of gas flow through the regenerator, heat is given up to and retrieved from the regenerator packing. Gas cyclicly flowing through the regenerator must be in heat exchange with the regenerator packing. A temperature differential is usually maintained across the ends of the regenerator. A regenerator may be employed in cycles where there are different pressures at different points around the cycle, or may be employed in Vuilleumier type of refrigeration cycle. Large regenerators in massive cryogenic equipment do not have size and weight limits and as a result are not subjected to critical design as far as size and weight parameters are concerned. However, regenerators which are part of cryogenic equipment which is subject to size and weight limitations must be carefully and critically designed. Particular patents disclosing compact or miniaturized Vuilleumier regrigerators include K. W. Cowans, U.S. Pat. Nos. 3,379,026 and Re. 27,338. G. P. Lagodmos, U.S. Pat. No. 3,742,719 also shows such a refrigerator. The basic thermodynamic cycle is shown in Vuilleumier U.S. Pat. No. 1,275,507.

SUMMARY

In order to aid in the understanding of this invention, it can be stated in essentially summary form that it is directed to a cryogenic regenerator, particularly a regenerator having sidewall features which inhibit blowby past the regenerator packing along the regenerator wall, and may also have the feature of improved gas flow distribution into the regenerator packing. In most cases the packing is metallic spheres.

It is thus an object of this invention to provide a cryogenic regenerator having characteristics which permit miniaturization of the regenerator so that a high efficiency regenerator is provided particularly for compact and miniaturized cryogenic equipment. It is another object to provide a cryogenic regenerator wherein the walls of the regenerator have parallel grooves therein into which loose regenerator packing can extend to inhibit packing blowby. It is another object to provide improved distribution at the end of the regenerator packing to minimize dead volume and improve gas flow distribution.

Other objects and advantages of this invention will become apparent from a study of the following portion of this specification, the claims and the attached drawings.

BRIEF DESCRIPTION OF THE DRAWINGS

FIG. 1 is a side elevational view of a miniaturized Vuilleumier refrigerator having the improved cryogenic regenerator of this invention incorporated therein.

FIG. 3 is an enlarged detail of one end of the second stage regenerator illustrated in FIG. 2.

DESCRIPTION OF THE PREFERRED EMBODIMENT

Figure 2:
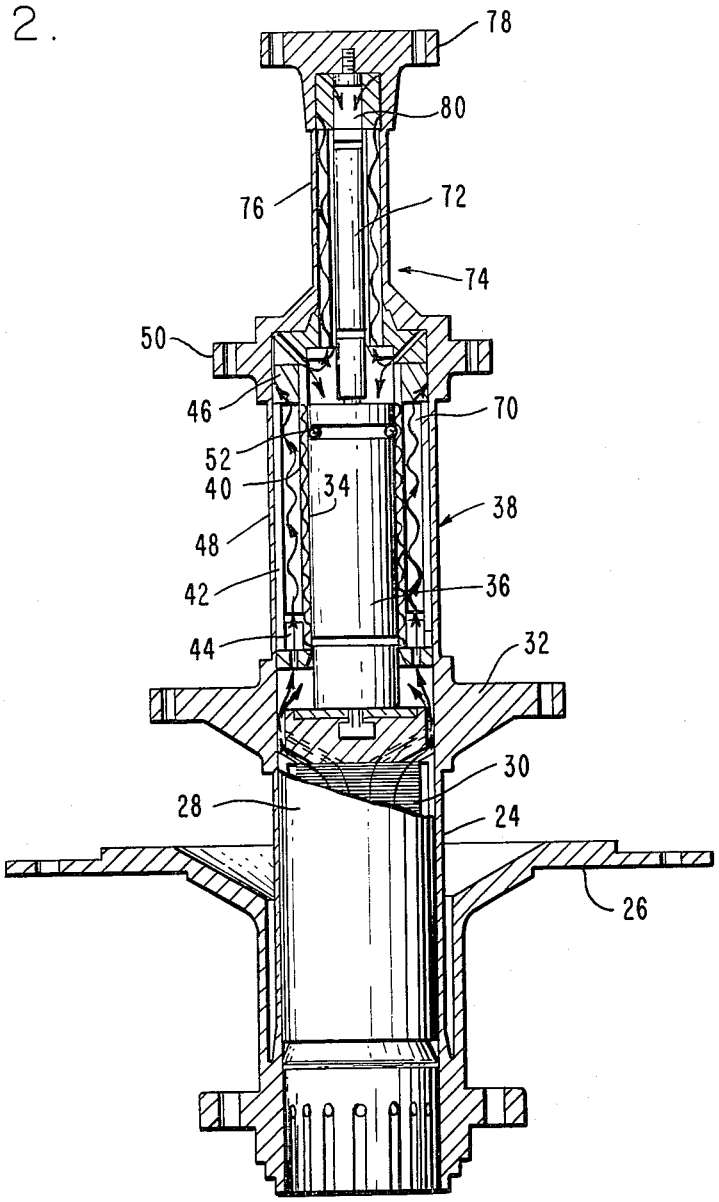
FIG. 2 is a side elevational view of the cold displacers of the refrigerator of FIG. 1, with parts broken away and most parts taken in central section.

Refrigerator 10 is of the Vuilleumier type and is employed to illustrate a system in which the cryogenic regenerator of this invention can be employed. Refrigerator 10 has a central crank housing 12 which has therein a crank which has its speed controlled by a motor in motor housing 18. Housings 14 and 16 each carry a hot displacer connected to be driven by the crank. Displacer 20 is shown in FIG. 1, through a broken-away portion of housing 16. Heater 22 heats the gas as it is displaced by the hot displacer. Similar structure is located in housing 14. The two hot displacers operate together and serve the same function as one larger displacer. The space at the outer end of the hot displacer is the hot space while the crankcase end of the hot displacer is at a temperature to reject heat to the ambient. The hot regenerator interconnects the hot space and the crankcase space on the opposite end of the hot displacers.

In the present case, a three-stage cooler is illustrated. The insulating dewar is removed from the structures in FIGS. 1 and 2 so that the cold finger structure can be better seen. Furthermore, the cold and intermediate temperature radiation shields are also removed for this purpose. As is best seen in FIG. 2, first stage cylinder 24 is supported on ambient flange 26 and it contains first stage displacer 28. First stage displacer 28 has an internal regenerator 30 which is connected to the gas spaces on both ends of the displacer. Such internal regenerators are well-known, and often are formed of stacked layers of woven copper screen. First stage flange 32 surrounds the space at the top of the first stage displacer and first stage temperature loads can be connected at that point. Such first stage temperature loads may include radiation shielding or may include other types of cryogenic refrigeration loads.

Second stage cylinder 34 has second stage displacer 36 therein. Second stage regenerator 38 is positioned exteriorly of cylinder 34. The second stage regenerator assembly consists of two synthetic polymer composition material concentric tubes, inner tube 40 and outer tube 42, bonded to metal header caps 44 and 46. The material of tubes 40 and 42 is chosen to be sufficiently strong for the purpose, but also by having low thermal conductivity they limit longitudinal heat flow. The exterior, second stage sleeve 48 extends from first stage flange 32 to second stage flange 50. A very thin metal interior sleeve is positioned within inner tube 40 in order to provide a riding surface for the rider ring 52 on the second stage displacer. The second stage cylinder sleeve is very thin to minimize heat flow along the length of the second stage.

The details of second stage regenerator assembly 38 are shown in FIG. 3. Both inner tube 40 and outer tube 42 are provided with grooves, such as the grooves 54 illustrated in inner tube 40 and grooves 56 illustrated in outer tube 42. The grooves are shaped with a 60° total included angle and are preferably annular rather than spiral. Each annular groove is thus its own entity rather than being spirally arranged along the regenerator tube surface. It is thought that a spiral groove would permit a small amount of gas to flow along the length of the spiral, outside of the main mass of the regenerator. The annular space between the inner and outer tubes is filled with regenerator packing 58. Regenerator packing 58 is in the form of lead spheres. In the miniature cryogenic refrigerator 10 illustrated, the lead spheres are 0.003 inches in diameter. Of course, the size of the regenerator spheres is related to the regenerator size and this in turn is related to the size of the refrigerator. The grooves in the regenerator tubes are sufficiently deep so that at least one regenerator sphere can lie therein, and as is illustrated in FIG. 3, it is preferable that the second row of regenerator spheres lie halfway into the grooves. The grooves, in conjunction with the spheres which form the regenerator packing, prevent an open end-to-end passage through the regenerator which may otherwise appear, especially when the regenerator lies on a horizontal axis. If the walls of the regenerator were smooth, then with the regenerator lying on a horizontal axis a void would form along the topmost wall, due to regenerator packing sphere settling, and this void would permit end-to-end gas flow without heat exchange, thus seriously reducing the regenerator efficiency.

The ends of the regenerator assembly 38 are also especially designed to improve regenerator efficiency. The lower end construction of regenerator assembly 38 is illustrated in FIG. 3. Header cap 44 is annular in shape and has a series of axial openings 60 therethrough. At the lower end these openings are open through 60° conical inlets 61 to the upper space around first stage displacer 28. At the upper ends, axial openings 60 enter into annular groove 62 which extends around the entire upper surface of annular lower header cap 44. An annular screen 64 is positioned over annular groove 62 and lies against the top face of lower annular header cap 44. Annular wool felt pad 66 is placed on screen 64 and annular screen 68 is positioned on top of the wool felt pad. Regenerator packing spheres 58 lie against the top of screen 68. Each of the screens 64 and 68 is a single layer of woven screen material. The screen material is sized so that the regenerator packing spheres are the same size or slightly larger than the screen openings. Since the spheres hang up in the screen openings or lie on the felt, they are not lost. The screens thus provide about 22% opening area for gas flow, because the spheres lie in the openings. This is more open area than is found with smaller screen.

Assembly 70, see FIG. 2, is a similar screen-wool-screen assembly at the top of the regenerator just below upper header cap 46. Upper header cap 46 is also provided with an annular groove on its lower face and with through holes which cooperate with other inner drilling to interconnect the top of regenerator assembly 38 with the space above second stage displacer 36.

During assembly of the regenerator, there is sufficient loading of regenerator spheres that the wool felt both at the top and the bottom compresses to provide axial resiliency and act as a spring to retain compression on the regenerator packing. The wool felt remains pliable and resilient at cryogenic temperatures. The regenerator spheres are preferably made of lead because of its high specific heat. The dimensional changes of the spheres due to temperature changes are communicated to the felt pad. In this way, Brinelling of the lead spheres against each other is minimized.

Third stage displacer 72 operates within third stage regenerator assembly 74. Third stage sleeve 76 extends from second stage flange 50 to third stage flange 78. It is to third stage flange that the lowest temperature, ultimate thermal load is coupled. The upper third stage displacer volume 80 is closed by flange 78 at its upper end and thus flange 78 is efficiently cooled to the lowest system temperature. Third stage regenerator assembly 74 is the same as the second stage regenerator assembly 38, including grooved inner and outer regenerator tubes made of synthetic polymer material, with regenerator packing in the form of spheres therein, preferably lead spheres. Furthermore, regenerator assembly 74 also has the annular screen-wool felt pad-annular screen assembly at both of its ends, the same as described in detail with respect to the lower end of regenerator assembly 38. A test of a cryogenic refrigerator having the regenerator structure of assembly 38 as the second and third stage regenerators with helium as the cryogenic fluid achieved 7° Kelvin at the third stage flange 78 and 10° Kelvin at second stage flange 50. This test result was independent of regenerator orientation. Previous tests with smooth-sided regenerator walls showed less refrigeration capacity with some regenerator orientations.

As the crank moves the displacers in their cylinders the volumes change in the cylinders at opposite ends of the displacers. This change in volume causes flow of gas through the various regenerators. The gas exchanges heat with the regenerator packing and in a properly designed refrigerator refrigeration is achieved, as described above.

This invention having been described in its preferred embodiment, it is clear that it is susceptible to numerous modifications and embodiments within the ability of those skilled in the art and without the exercise of the inventor faculty. Accordingly, the scope of this invention is defined by the scope of the following claims.

I claim:

1. A thermal regenerator comprising:

a wall enclosing a regenerator space with an inlet at one end of said wall and an outlet at the other end of said wall to define a flow direction, grooves in said wall, said grooves having a width, said grooves being oriented at an angle with respect to the flow direction;

regenerator packing positioned within said regenerator and constrained by said walls, said regenerator packing being formed of discrete members which can exchange heat with gas passing through said regenerator packing, said discrete members having a major dimension at least as small as the width of said grooves.

2. The regenerator of claim 1 wherein said grooves are annular grooves substantially at right angles to the flow direction.

3. The regenerator of claim 2 wherein said regenerator packing comprises metallic spheres made principally of lead.

4. The regenerator of claim 1 wherein there is a wool felt pad adjacent at least one end of said regenerator and a screen is positioned against said wool felt pad so that said regenerator packing is compressed by said wool felt pad and is separated from said wool felt pad by said screen.

5. The regenerator of claim 4 wherein there is a wool felt pad and a screen at each end of said regenerator.

6. The regenerator of claim 5 wherein said regenerator packing is metal substantially in the form of spheres and principally made out of lead and said lead screen on said wool felt pad has sufficiently small openings to prevent said spheres from passing said screen and entering said wool felt pad.

7. The regenerator of claim 4 wherein said regenerator packing is metal substantially in the form of spheres and principally made out of lead and said lead screen on said wool felt pad has sufficiently small openings to prevent said spheres from passing said screen and entering said wool felt pad.

8. The regenerator of claim 7 wherein said grooves are arranged at substantially right angles with respect to the flow direction.

9. The regenerator of claim 8 wherein said grooves are annular.

10. The cryogenic regenerator of claim 1 wherein said regenerator walls comprise a substantially cylindrical outer wall having an inner surface and a substantially cylindrical inner wall on the same axis and having an outer surface with said regenerator space annularly positioned between said walls, a cryogenic gas piston positioned within said inner wall, with the spaces on opposite ends of said piston being connected at opposite ends of said regenerator so that said regenerator is annular around said piston.

11. The regenerator of claim 10 wherein there is a wool felt pad adjacent at least one end of said regenerator and a screen is positioned against said wool felt pad so that said regenerator packing is compressed by said wool felt pad and is separated from said wool felt pad by said screen.

12. The regenerator of claim 11 wherein there is a wool felt pad and a screen at each end of said regenerator.

13. The regenerator of claim 12 wherein said regenerator packing is metal substantially in the form of spheres and principally made out of lead and said lead screen on said wool felt pad has sufficiently small openings to prevent said spheres from passing said screen and entering said wool felt pad.

14. The regenerator of claim 13 wherein said grooves are arranged at substantially right angles with respect to the flow direction.

15. The regenerator of claim 14 wherein said grooves are annular.

* * * * *